United States Patent [19]

Lawlor et al.

[11] Patent Number: 4,981,298

[45] Date of Patent: Jan. 1, 1991

[54] BALL DIVERTER PLAYFIELD FEATURE FOR PINBALL MACHINES

[75] Inventors: Pat Lawlor, Marengo; John R. Krutsch, Glenview, both of Ill.

[73] Assignee: Williams Electronics Games, Inc., Chicago, Ill.

[21] Appl. No.: 418,885

[22] Filed: Oct. 6, 1989

[51] Int. Cl.[5] ..... A63D 3/02

[52] U.S. Cl. ..... 273/121 A; 273/122 A; 273/123 A

[58] Field of Search ..... 273/121 A, 122 A, 123 A

[56] References Cited

U.S. PATENT DOCUMENTS

| | | | |
|---|---|---|---|
| 1,909,422 | 5/1933 | Passell | 273/121 A |
| 2,004,190 | 6/1935 | Breitenstein | 273/121 A |
| 2,086,327 | 7/1937 | Hameetman | 273/121 A |
| 3,897,951 | 8/1975 | Morrison et al. | 273/121 A |
| 4,606,545 | 8/1986 | Ritchie | 273/121 A |
| 4,773,646 | 9/1988 | Joos, Jr. et al. | 273/121 A |
| 4,822,046 | 4/1989 | Kim et al. | 273/121 A |

OTHER PUBLICATIONS

"Playmeter", 1 Mar. 1981, p. 2.

*Primary Examiner*—Edward M. Coven
*Assistant Examiner*—Raleigh W. Chiu
*Attorney, Agent, or Firm*—Rockey and Rifkin

[57] ABSTRACT

A ball diverting playfield feature for pinball games employs a pair of abutting surfaces disposed on or above the playfield, which can be separated to create an alternate ball path. A solenoid mechanism controls the positions of the surfaces.

14 Claims, 2 Drawing Sheets

FIG. 4
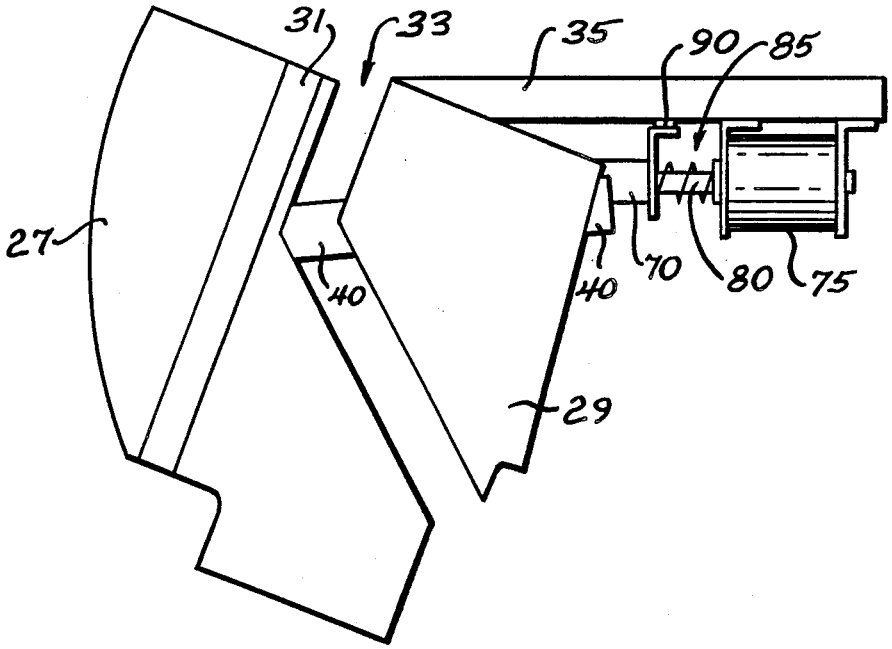
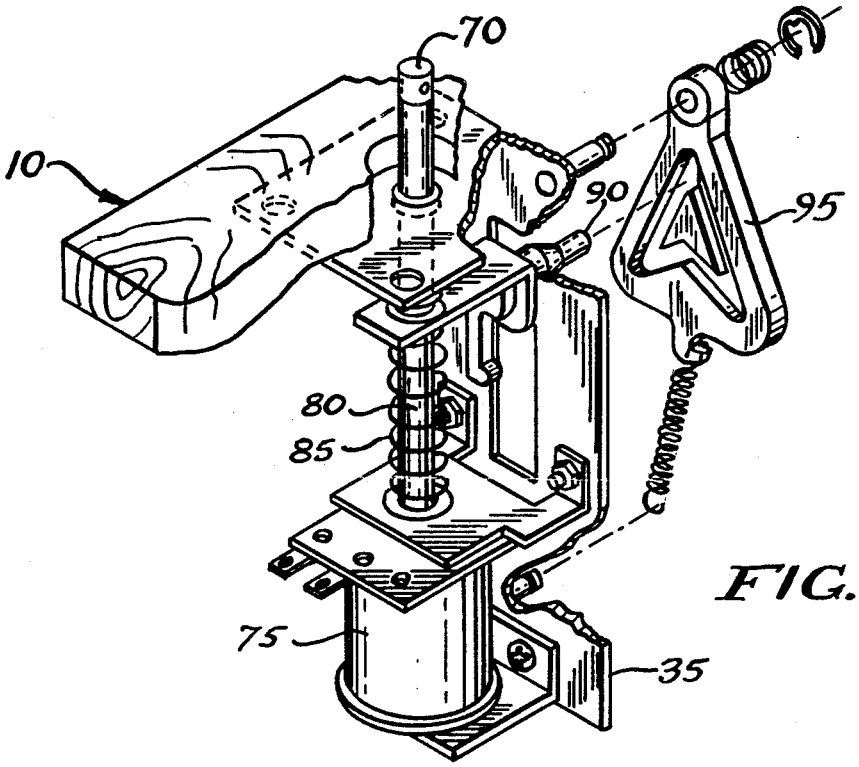
FIG. 5

BALL DIVERTER PLAYFIELD FEATURE FOR PINBALL MACHINES

BACKGROUND OF THE INVENTION

The present invention relates generally to pinball games, and more particularly to a playfield feature for pinball games.

Pinball games, as commonly known, consist of an inclined playfield and a plurality of play features arranged on the playfield. A player uses flippers or similar means to direct a ball at playfield features such as targets or ramps in order to score points.

Players are, however, selective as to the particular pinball machines they choose to play. Selection is based on a diversity of criteria, including the variety and originality of playfield features Thus, the success of a particular pinball game, or series of games, is dependent upon the inclusion of new and original playfield features in such games.

Accordingly, it is an object of the present invention to provide a novel playfield feature by which the path of the ball is altered as a result of a change in the configuration of the playfield feature.

It is another object of the invention to provide such a playfield feature in the form of a pair of separating parts, whereby a channel to guide ball movement is created as a result of the separation of the parts.

Still another object of the invention is to provide separating playfield surfaces, wherein said surfaces may optionally feature playfield features such as targets, bumpers and the like.

These and other objects of the invention will become apparent to those skilled in the art from the detailed description of the invention provided below.

SUMMARY OF THE INVENTION

The present invention is a ball diverter playfield feature for pinball games comprising two abutting portions, one of which may optionally have a path or groove which directs the ball to a specific exit point. Upon actuation of a solenoid or other separating means, the two abutting portions of the ball diverter are separated to create a different and distinct channel to receive the pinball. This channel diverts the pinball to a playfield area different from when the ball diverter portions are abutting.

In another embodiment, the playfield feature comprises two abutting playfield surfaces, each incorporating playfield features such as targets, bumpers, etc.

BRIEF DESCRIPTION OF THE DRAWINGS

FIG. 4 is a view similar to FIG. 2 in which the alternative ball path is active.

FIG. 5 is a partially cut away perspective view of the cam mechanism associated with the operation of one embodiment of the present invention.

DETAILED DESCRIPTION OF A PREFERRED EMBODIMENT

Figure 1:
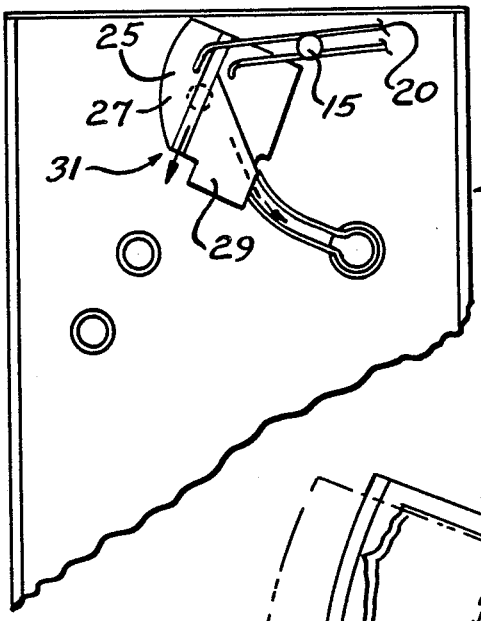
FIG. 1 is a plan view of the upper portion of a playfield having the present invention installed thereon.

Referring to the drawings, a pinball game playfield 10 is provided as shown, for example, in FIG. 1. Playfield

10 is typically inclined downward toward the bottom of the drawing to provide gravitational acceleration of ball 15 toward the lower end of the playfield and an out hole (not shown). The diverter of the present invention includes a ball guide 20 and surface portions 27 and 29.

As shown in FIG. 1, a ball 15 rolls on the playfield until it encounters ball guide 20, which may be a ramp leading to the ball diverter. The diverter is preferably disposed above the playfield in this embodiment. In normal play, ball 15 is deposited from ball guide 20 onto surface 25 and travels along ball path 31, which comprises an indentation or groove of effective width and depth to retain ball 15 therein. Ball path 31 may reside entirely on one of surface portions 27 and 29, or may reside in part on each portion.

Figure 2:
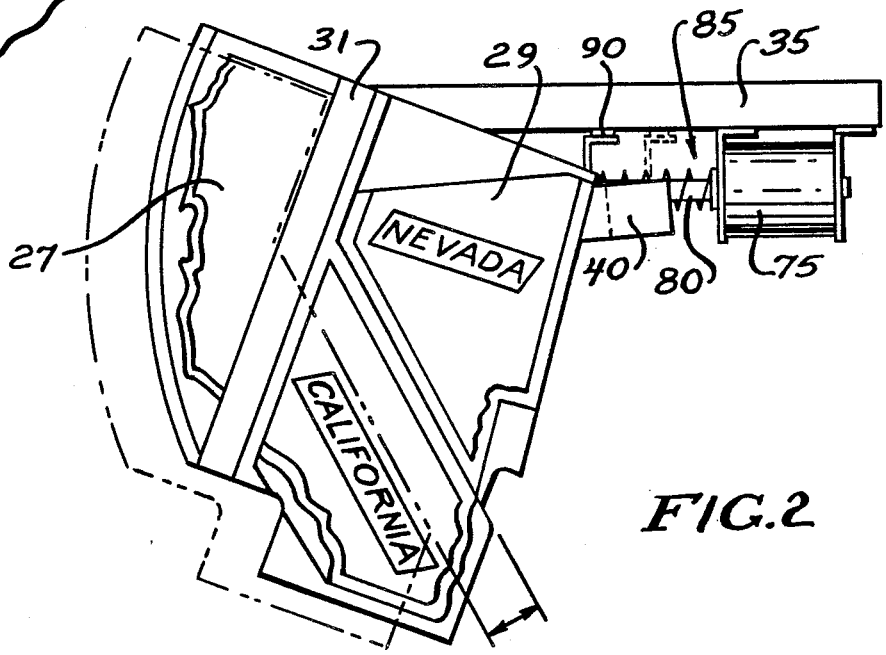
FIG. 2 shows a plan view of an embodiment of the present invention.

The detail shown in FIG. 2 further illustrates the location of ball path 31 in one particular embodiment of the invention. In this embodiment, the two portions 27 and 29, are configured to correspond, roughly, to the geographic boundaries of the states of California and Nevada. The ball path 31 resides entirely on portion 27. The ball travels along path 31 to an exit point where it reenters the playfield by way of a ramp (not shown) or dropping onto the playfield, as desired.

Figure 3:
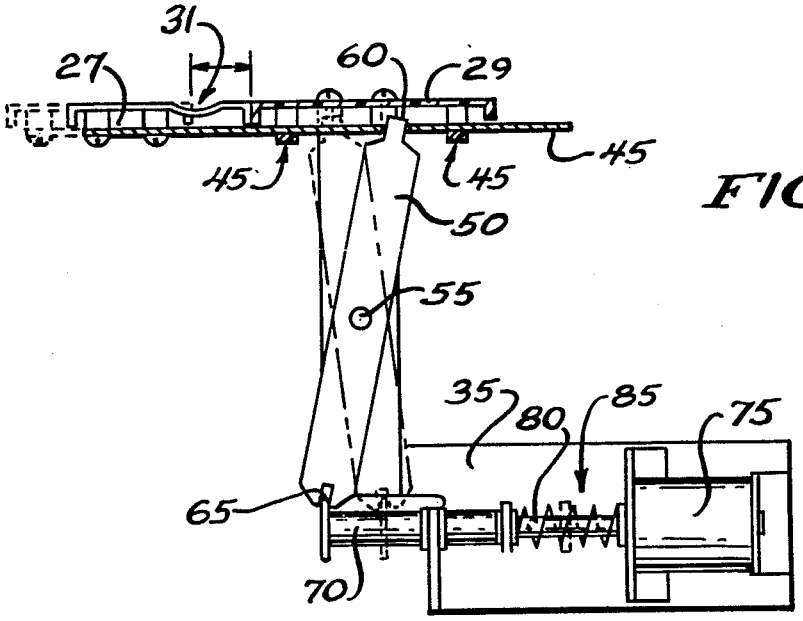
FIG. 3 shows a side view of the actuating mechanism used to operate the invention.

FIG. 3 shows that one portion 29 of the diverter is fixedly mounted to a plate 35. Surface portion 27 is rigidly mounted to slide 40, which communicates with portion 29 via slide passages 45. Such slide passages may preferably be provided to require that slide 40 move along a specified path, thereby ensuring that portions 27 and 29 properly abut. Slide 40 engages lever 50, which is pivotally mounted to plate 35 by pin 55. At its opposite end, lever 50 is coupled to shaft 70. The slide, lever, pin and shaft combine with solenoid 75 to form a solenoid controlled slide means.

Solenoid 75 is mounted on plate 35, and includes a plunger 80. Plunger 80 is disposed partially within solenoid 75 such that it is retracted into solenoid 75 when the solenoid is energized. Solenoid 75 may be energized as a result of any desired occurrence in the playfield or as a consequence of controller action triggered by the passage of time. Thus, rollover switches, drop targets, or other playfield features may separately or in combination be employed to cause the solenoid to energize.

Energization of the solenoid retracts plunger 80 into the solenoid. Shaft 70 is coupled to plunger 80. Retraction of the plunger results in corresponding movement of shaft 70. Plunger 80 is biased by spring 85 against a cam guide 95 (FIG. 5) and includes a cam 90 (FIG. 4) for placing the separating playfield feature in one of two selected configurations. Placement is achieved by use of a cam mechanism described in U.S. Pat. No. 4,822,046, hereby incorporated by reference. FIG. 5 is explained in greater detail in that patent. Energization of the solenoid retracts plunger 80, moving cam 90 from a first position, wherein the ball diverter is closed, to a second position, wherein the ball diverter is open or separated.

Movement of plunger 80, and consequently shaft 70, causes lever 50 to pivot on pin 55, resulting in the movement of slide 40 through slide passages 45. Diverter surface portion 27, being mounted on slide 40, is thus displaced from portion 29. This movement between closed and open positions, is shown in phantom in FIG. 3.

As shown in FIG. 4, ball path 31 is also displaced as a result of this movement, and a channel 33, an alternative ball path, is formed between portions 27 and 29.

Upon deenergization of the solenoid, spring 85 biases plunger 80 and attached cam 90 into the second position of the cam guide, as described in U.S. Pat. No. 4,822,046.

Channel 33 is proportioned to accommodate ball 15 and to guide the movement of the ball. The displacement of ball path 31 with the formation of channel 33 results in ball 15 being deposited from ball guide 20 into channel 33, as shown by the dashed arrow in FIG. 1. The ball travels in the alternate channel back to the playfield to a different location than if it had travelled along ball path 31. Thus, in the second position, the feature of the present invention diverts the ball to a different playfield area.

This capability can be used in conjunction with various scoring and skill features. For example, diversion might require obtaining a certain minimum number of points. Thereafter, directing the ball onto the diverter might result in the award of bonus points.

In addition, the different exit from the diverter might lead to other features rather than back to the playfield. For example, additional ramps or targets might be located at or near the exits.

Channel 33 may be closed by activity on the playfield or from the controller and separating playfield feature surface portions 27 and 29 are rejoined in abutting configuration, such that a ball from ball guide 20 may once again be deposited in ball path 31. This is accomplished by a second energization of solenoid 75, retracting plunger 80 and moving cam 90 from the second position of the cam guide. Upon deenergization of the solenoid, cam 90 returns to its first position, and the separating playfield feature portions are placed in the abutting position shown in FIG. 2.

It is also possible to configure the present invention so that no ball path, e.g., ball path 31, is initially present. In such a configuration, a ball path is created only upon separating the portions of the playfield feature, as described above. The separating playfield feature may also be employed as an entrance to an alternate playfield. The feature can also be mounted flush with the playfield, in which case no ramp or ball guide is necessary.

In still another embodiment, the two portions may comprise a playfield surface upon which other playfield features are positioned. Such other playfield features are known to those in the art to include bumpers, targets, ramps and the like. The means for separating the portions in this embodiment would be, for example, as set forth above and shown in the illustration. Other separating means, however, may be usefully employed to equal advantage, depending upon the configuration of the separating playfield feature.

The present invention has been described with respect to certain embodiments and conditions, which are not meant to and should not be construed to limit the invention. Those skilled in the art will understand that variations from the embodiments and conditions described herein may be made without departing from the invention as claimed in the appended claims.

What is claimed is:

1. A playfield feature for pinball games, comprising:

(a) a pair of substantially horizontal surfaces positioned in abutting relationship above said playfield;

(b) means for separating said surfaces to create a channel therebetween in which a pinball can travel; and, (c) means for conveying a pinball onto said surfaces for movement thereon.

2. The playfield feature of claim 1, wherein said pair of surfaces define a first ball path when in an abutting relationship, said channel constituting a second ball path when said surfaces are separated;

whereby the pinball can be diverted from the first ball path to the second path.

3. The playfield feature of claim 2, wherein said first ball path resides entirely on one of said surfaces.

4. The playfield feature of claim 1, wherein said means for separating said surfaces comprises a solenoid controlled slide means.

5. The separating playfield feature of claim 1, wherein at least one of said surfaces includes at least one playfield feature selected from the group consisting of targets, bumpers, and ramps, positioned on said surface.

6. The separating playfield feature of claim 4, wherein at least one of said surfaces includes at least one playfield feature selected from the group consisting of targets, bumpers, and ramps, positioned on said surface.

7. A ball diverting playfield feature for pinball games, comprising:

(a) a pair of substantially horizontal surfaces positioned in abutting relationship above said playfield, said pair of surfaces defining a first ball path when in said abutting relationship;

(b) means for separating said surfaces to create a channel therebetween in which a pinball can travel, said channel constituting a second ball path when said surfaces are separated; and, (c) means for conveying a pinball onto said surfaces for movement thereon.

8. The separating playfield feature of claim 7, wherein said means for separating said surfaces comprises a solenoid controlled slide means.

9. A ball diverting playfield feature for pinball games, comprising:

(a) a pair of surfaces positioned in an abutting relationship above said playfield, said pair of surfaces defining a first ball path when in an abutting relationship, said first ball path residing entirely on one of said surfaces;

(b) means for separating said surfaces to create a channel therebetween in which a pinball can travel, said channel constituting a second ball path when said surfaces are separated; and, (c) means for conveying a pinball onto said surfaces for movement thereon.

10. A ball diverting playfield feature for pinball games, comprising:

(a) a pair of substantially horizontal surfaces positioned in an abutting relationship on a playfield; and, (b) means for separating said surfaces to create a channel therebetween in which a pinball can travel.

11. The playfield feature of claim 10, wherein said pair of surfaces define a first ball path when in an abutting relationship, said channel constituting a second ball path when said surfaces are separated;

whereby the pinball can be diverted from the first ball path to the second path.

12. The playfield feature of claim 11, wherein said first ball path resides entirely on one of said surfaces.

13. A playfield feature for pinball games, comprising:

(a) a pair of surfaces positioned in abutting relationship;

(b) at least one playfield feature selected from the group consisting of targets, bumpers and ramps positioned on at least one of said surfaces; and (c) means for separating said surfaces.

14. The playfield feature of claim 13, wherein said means for separating said surfaces comprises a solenoid controlled slide means.

* * * * *